US006669429B2

(12) United States Patent
Beermann et al.

(10) Patent No.: US 6,669,429 B2
(45) Date of Patent: Dec. 30, 2003

(54) DEVICE FOR MANUFACTURING BOOK-BINDING COVERS

(75) Inventors: Jens E. Beermann, Rahden (DE); Gerhard Lintelmann, Rahden (DE); Peter Gross, Rahden-Sielhorst (DE); Frank Tautz, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 80 days.

(21) Appl. No.: 09/989,237

(22) Filed: Nov. 19, 2001

(65) Prior Publication Data

US 2002/0061240 A1 May 23, 2002

(30) Foreign Application Priority Data

Nov. 21, 2000 (DE) ..... 100 57 602

(51) Int. Cl.[7] ..... B42C 11/02

(52) U.S. Cl. ..... 412/19; 270/52.18; 270/58.08; 412/1; 412/5; 412/23

(58) Field of Search ..... 412/1, 3, 4, 5, 412/9, 17, 18, 19, 21, 22, 23, 24; 281/29, 21.1, 15.1; 270/52.01, 52.08, 52.18, 58.07, 58.08

(56) References Cited

U.S. PATENT DOCUMENTS 4,111,739 A * 9/1978 De Bin et al. ..... 156/486
4,764,073 A * 8/1988 Garlichs et al. ..... 412/9
4,889,461 A * 12/1989 Kampen et al. ..... 412/19
5,259,825 A * 11/1993 De Angelis et al. ..... 493/177
6,379,094 B1 * 4/2002 Porat ..... 412/9

FOREIGN PATENT DOCUMENTS

DE 22 26 446 12/1972
DE 42 13 220 A1 10/1993

OTHER PUBLICATIONS

German Search Report dated Oct. 18, 2001.

* cited by examiner

*Primary Examiner*—Monica Carter
(74) *Attorney, Agent, or Firm*—Alix, Yale & Ristas, LLP

(57) ABSTRACT

Apparatus for manufacturing book-binding covers including a board-feeding-in system for feeding in cover boards and a back insert and a copy-feeding-in system for feeding in reference copies. A copy cylinder grips the reference copies, guides them past a glue-applying roll, and joins them to the cover boards and back insert. A tucking-in and pressing-on device folds the protruding reference-copy edges round the board edges and presses the book covers on. A feeding-out device delivers the book covers in stacks. The material flow of the book boards, back inserts, reference copies, and book covers is orientated in an ascending manner in relation to the horizontal surface on which the apparatus stands. The gain in height thus achieved compensates for the losses in height in the board magazine, in the tucking-in system, in the feeding-out device, and on the onward conveyers so that the laying-on of the cover boards takes place at virtually the same, ergonomic working height as the taking-off of the book covers.

14 Claims, 2 Drawing Sheets

DEVICE FOR MANUFACTURING BOOK-BINDING COVERS

BACKGROUND OF THE INVENTION

The invention relates to a device for manufacturing book-binding covers.

Devices of this type are known as "book-covering machines with a horizontal processing principle" [Liebau; Heinze, *Industrielle Buchbinderei* (Industrial Bookbinding), publ. Beruf+Schule, Itzehoe 1997, chap. 5.5.2; pp: 399 ff.], in which reference copies which are fed in via a copy cylinder and glued on an applying roll are joined, by rolling-on in a continuous running-through operation, to cover boards and back inserts which are fed in a linear manner. The book covers are then passed over, with the reference-copy edges still protruding, to a tucking-in device which folds the protruding edges round the board edges and onto the inner sides of the boards and presses them on, in successive, separate work stations for tucking in the head/foot and tucking in the sides. Finally, the book covers are pressed on with the aid of press rolls belonging to a pressing-on station and are guided in stacks out of the book-covering machine in a feeding-out device, at which point they are stored on a roller table until they are taken off manually.

Under these circumstances, the cover boards and back insert and also the joined-together book covers are moved through the machine essentially in a rectilinear material flow and, in the known book-covering machines, the plane of the said material flow is disposed parallel to the horizontal surface on which the machine stands. The finished book covers are deposited on top of one another in stacks in the feeding-out device, through the fact that partial stacks are formed in an intermediate plane, which are set down in the feeding-out plane to form a book-cover stack up to 100 mm in height. Because of this, the feeding-out level of the book-cover stacks lies about 150 mm lower than the material-flow plane of the book covers. The cover boards are decollated from a board magazine holding a stack of cover boards, and are advanced by the rear edge to the joining point. For reasons of efficiency, there is associated with the board magazine a prestacking band which stockpiles a fairly large number of cover boards, either as a stack or in imbricated formation, and feeds them successively to the board magazine. The board magazine has an approximate stacking height of 80 mm, as a result of which the level of the prestacking band lies higher than the material-flow plane of the boards by that extent.

Tucking-in systems are known in which book covers are brought downwards, when the protruding reference-copy edges are tucked in, in layers which are offset in a parallel manner, only to thereupon be transported onwards in a horizontal direction. The extent of this vertical offset may amount to 100 mm or more. With the aid of the abovementioned roller table, the book-cover stacks are guided, in the simplest manner, to any desired take-off point outside the machine, and after that it is possible to store a number of book-cover stacks until they are taken off. The force of gravity of the book-cover stack on an inclined plane is used for conveying purposes, it being necessary to make provision for a difference in height of about 80 to 120 mm for a roller table 3 to 4 m long.

Even considered on their own, the board magazine and the feeding-out device result in a difference in height of about 230 mm, by which the finished book covers are fed out lower than the cover boards are laid on. This difference in height leads to the fact that, with the laying-on of the cover boards at an ergonomic height, the taking-off of the finished book covers takes place at too low a level, if no further devices are provided in this respect. Conversely, the laying-on of the cover boards takes place at too high a level if the taking-off of the book covers is carried out at an ergonomic height. In a book-covering machine, by far the greatest throughputs of material are achieved in the laying-on of the cover boards and also in the taking-off of the book covers. Therefore, both areas of activity should be ergonomically configured as far as possible.

For a man of average size (178 cm), a height of 950 mm is proposed in [*Ergonomie in Druckereien und der Papierverarbeitenden Industrie* (Ergonomics in Printing Offices and the Paper-Processing Industry), Berufsgenossenschaft Druck und Papierverarbeitung (Printing and Paper-Processing Employers'Liability Insurance Association), Wiesbaden 1994, chap.: 7 Working heights; pp.; 41 ff.] as the ergonomic working height for laying on and taking off medium weights while in the standing position, whereas a height of 860 mm is recommended for a woman of average size (163 cm). A range from 900 to 1000 mm has emerged as the working height which is to be aimed at and at which both men and women are able to lay on cover boards or take off finished book covers in an ergonomic manner.

If the roller table is also taken into consideration, the difference in height already increases to more than 300 mm. Such a machine can no longer be operated ergonomically without using platforms. If use is made, in such a book-covering machine, of a tucking-in system which conveys the book covers into still lower planes, the difference in height increases to more than 400 mm. This problem can only be circumvented by the use of further devices, such as lifting tables for example.

SUMMARY OF THE INVENTION

The object of the invention consists in improving a device of the generic type for manufacturing book-binding covers, to the effect that cover boards and book covers can be laid on and taken off, respectively, at ergonomic working heights without using additional devices.

The invention achieves the object in a surprisingly simple and economic way through the fact that, in a generic device, the material flow of the boards and book covers as far as the feeding-out device is orientated in an ascending manner in relation to the horizontal surface on which the machine stands.

By means of the ascending material flow from the board magazine as far as the feeding-out device, it is possible to make up for the downwardly directed height offset, in a book-covering machine operating on the horizontal processing principle, between the prestacking band for the cover boards and the roller table for the book-cover stacks, in such a way that both the laying-on of the cover boards and the taking-off of the book-cover stacks take place at ergonomic heights. Even with an angle of ascent of 3°, an upwardly directed height offset of 157 mm is achieved in the case of a 3000 mm-long material flow extending in an ascending plane, as a result of which the downwardly directed height offset in the stacking of the book covers is more than made up for.

An angle of ascent of 8°, which is the preferred choice, results in an upwardly directed height offset of about 420 mm, if the material flow extends over an overall length of 3000 mm. This gain in height compensates for the loss in height in the board magazine (about 80 mm), in the feeding-out device (about 150 mm) and in the roller table (about 80 mm), in such a way that even a downwardly directed parallel displacement during the tucking-in of protruding reference-copy edges (about 120 mm) is virtually counteracted.

In an advantageous further development, the copy-feeding-in system is disposed below the tucking-in and pressing-on device, and the copy magazine lies in front of the feeding-out device, viewed in the direction of material flow of the boards and book covers. Because of the material flow of the book covers which ascends towards the rear, the material-flow plane of the reference covers can be raised to an extent such that an ergonomic laying-on height for the copy magazine is produced, even when the working heights for the laying-on of the cover boards and the taking-off of the book-cover stacks are designed in an ergonomic manner.

BRIEF DESCRIPTION OF THE DRAWINGS

The invention will be explained in greater detail below with the aid of the exemplified embodiment represented in the drawings, in which.

DETAILED DESCRIPTION OF THE PREFERRED EMBODIMENT

Figure 1:
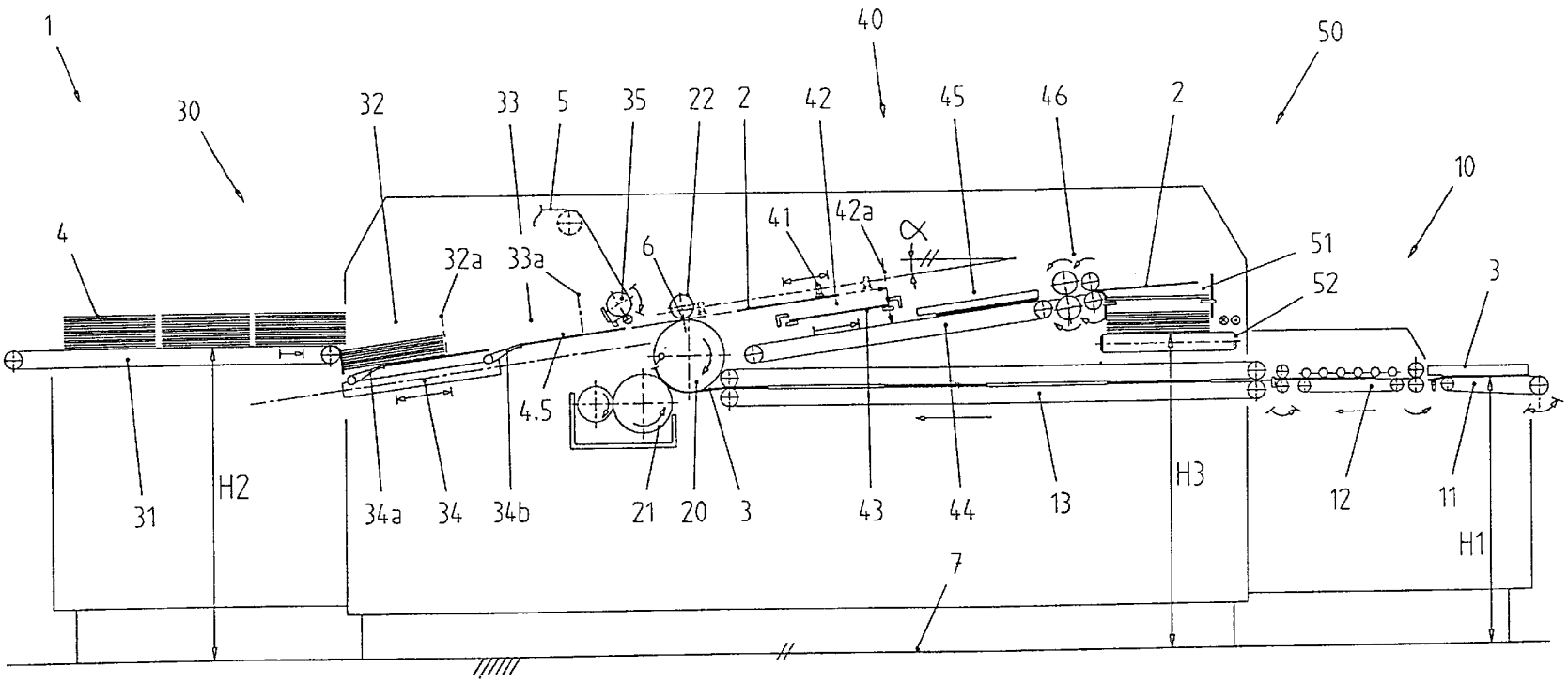
FIG. 1 shows a book-covering machine, represented diagrammatically in side view.
Figure 2:
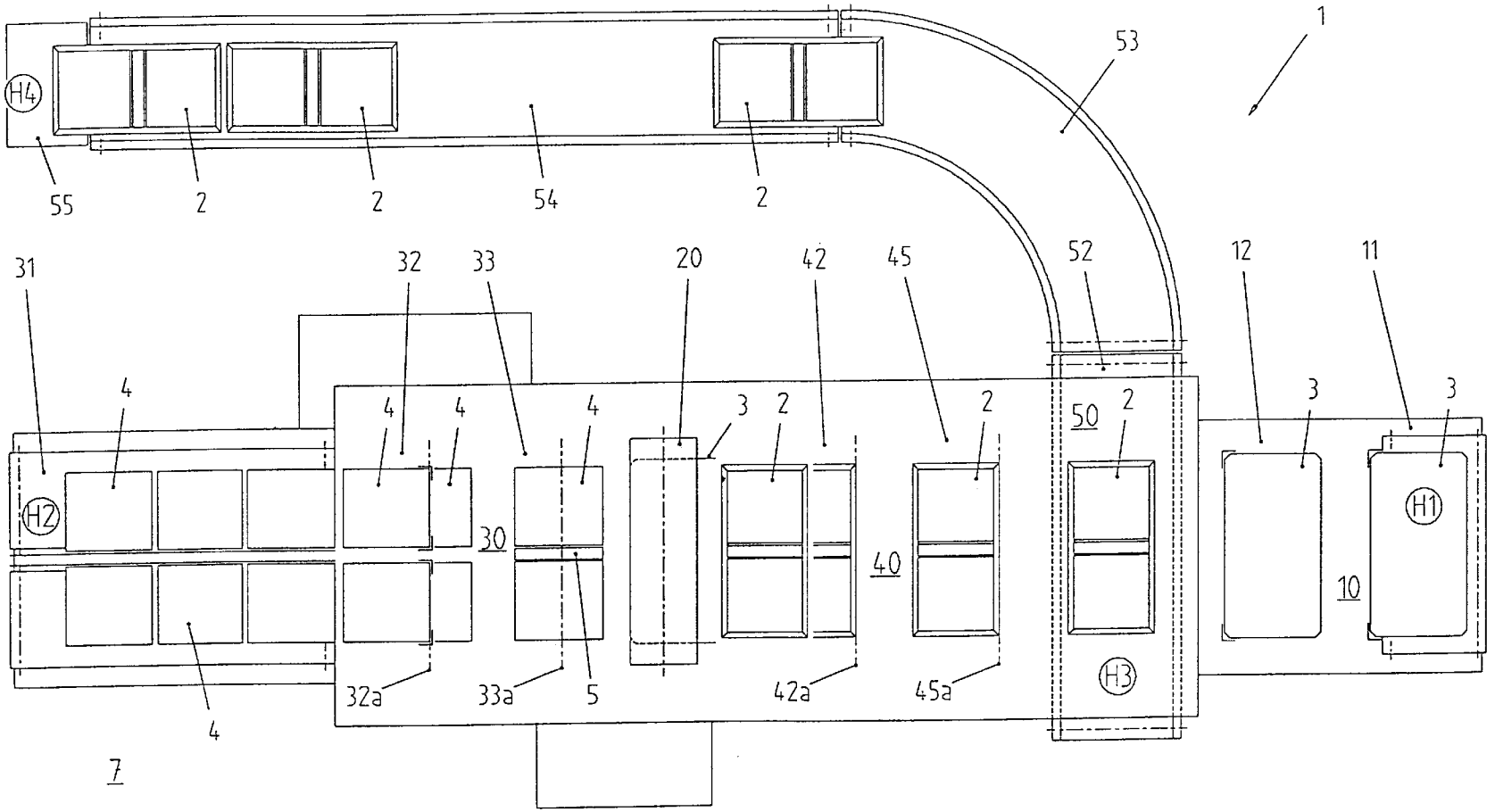
FIG. 2 shows a book-covering machine in plan view.

The Figures show, in a diagrammatically simplified representation, a book-covering machine 1 in which book covers 2 are manufactured by the joining of glued reference copies 3 to cover boards 4 and back inserts 5. The reference covers 3 are decollated from a copy magazine 11 with the aid of a known copy-feeding-in system 10, are aligned at the front edge and towards one side in a copy-aligning device 12, and are transported forwards, clamped between a number of pairs of transporting belts positioned at a distance from one another, via a copy-transporting device 13, and passed over to a continuously rotating copy cylinder 20 which takes over the reference copies 3 with the aid of grippers, guides them past a glue-applying roll 21 and delivers up again at the joining point 6. A left-hand and a right-hand cover board 4, and also a back insert 5 are fed to the said joining point 6 in a board-feeding-in system 30, synchronously with the particular reference copy 3. At the said joining point 6, pressing-on rollers 22 which act separately on the cover boards 4 and the back insert 5 ensure that the reference copies 3 are rolled onto the boards 4, 5 in a bubble-free manner.

Associated with the board-feeding-in system 30 is a prestacking band 31 which feeds the cover boards 4 stackwise to a board magazine 32. The said board magazine 32 has a format-fixed reference edge 32*a* against which the cover boards 3 rest with their front edge. For different format heights, the prestacking band 31 is positioned accordingly. The feeding-in of the boards 4, 5 takes place via a board-pusher 34 which travels to and fro and which, with the aid of a first board-pusher 34*a*, transfers the cover boards 4 out of the board magazine 32 and into an intermediate position 33. The intermediate position 33 has a format-fixed reference edge 33*a*. In the said intermediate position 33, a screening-board-feeding-in device 35 brings in the back insert 5 which is cut into lengths from a web of material and is then fed, together with the cover boards 4, to the joining point 6 by the second board-pusher 34*b*.

The board-feeding-in plane is orientated in such a way in relation to the floor 7 that the cover boards 4 and the back insert 5 are advanced in an ascending manner in the direction of transport at an angle of ascent α. After the joining-together operation at the joining point 6, the book cover 2 is first of all transported, in the same ascending plane, into a tucking-in and pressing-on device 40, through the fact that a suction beam 41 takes over the book cover 2 and conveys it, by its front edge, as far as a format-fixed reference edge 42*a* in a head/foot-tucking-in station 42. In the latter, the book cover 2 is brought, by means which are not represented here, into a parallel-offset, lower tucking-in position 43 in which the protruding reference copy edges are tucked-in at the head and foot of the said book cover 2. After the tucking-in operation, the book cover 2 is once again displaced downwards into a new plane of transport which is constructed virtually parallel to the upper feeding-in plane of the tucking-in and pressing-on device 40 and in which a band conveyer 44 transports the book cover 2 onwards as far as a format-fixed reference edge 45*a* in a side-tucking-in station 45.

After the tucking-in of the sides, the book cover 2 is fed to a pressing-on station 46 in which pressing-on rolls press the reference copy 3 firmly against the cover boards 4 and the back insert 5. By means of the pressing-on rolls of the pressing-on station 46, the book cover 2 passes into an upper stacking plane 51 in a feeding-out device 50 in which a preselectable number of book covers 2 are laid on top of one another to form partial stacks. A number of partial stacks are deposited on a feeding-out band 52 to form the book-cover stack which is then transferred, transversely out of the book-covering machine 1, onto a curved conveyer 53 with the aid of the said feeding-out band 52. The said curved conveyer is followed by a roller table 54 which ends in a take-off table 55. The curved conveyer 53 and the roller table 54 are provided with freely rotating, non-driven rollers, and have an inclined conveying plane, as a result of which the book-cover stacks arrive at the take-off table 55 automatically and a number of book-cover stacks can be stored in the simplest manner. For checking purposes or when setting-up the book-covering machine 1, individual book covers 2 or even stacks of book covers 2 can be moved out towards the other side of the said book-covering machine 1.

It can be seen from FIG. 1 that, because of the ascending material flow of the boards 4, 5 and book covers 2, the feeding-out height H3 of the feeding-out band 52 is virtually the same as the laying-on height H2 of the horizontally disposed prestacking band 31, although the cover boards 4 or book covers 2 are, in the course of their material flow, offset a number of times into transporting planes which are located lower down. The laying-on height H2 of the prestacking band 31 and the feeding-out height H3 of the feeding-out band 52 can be set to an ergonomically favourable working height of, for example, 980 mm in each case, when the book-covering machine 1 is erected. The take-off height H4 at the take-off table 55 of the roller table 54 lies about 80 mm lower on account of the inclination of the transport route. With the aid of the take-off height of 900 mm resulting therefrom, the book-cover stacks can be taken off within the ergonomically favorable range.

The angle of ascent α is in the range of 3° to 25°. Even with an angle of ascent a of 3°, an upwardly directed height offset of 157 mm is achieved in the case of a 3000 mm-long material flow extending in an ascending plane, as a result of which the downwardly directed height offset in the stacking of the book covers 2 is more than made up for. An angle of ascent of 8°, which is the preferred choice, results in an upwardly directed height offset of about 420 mm, if the material flow extends over an overall length of 3000 mm.

This gain in height compensates for the loss in height in the board magazine 32 (about 80 mm), in the feeding-out device 50 (about 150 mm) and in the roller table 54 (about 80 mm), in such a way that even a downwardly directed parallel displacement during the tucking-in of protruding reference-copy edges (about 120 mm) is virtually counteracted.

The ascending material flow of the book covers 2 in the region of the tucking-in and pressing-on device 40 also makes it possible to dispose the copy-feeding-in system 10 below the tucking-in, pressing-on and feeding-out device 40, 50. The laying-on height H1 resulting therefrom for the copy magazine 11 lies, at 850 mm, within the ergonomically favourable range. Thus, all the essential laying-on and taking-off heights in the book-covering machine 1 lie at ergonomically favourable working heights.

What is claimed is:

1. Apparatus for manufacturing book-binding covers from cover boards, back inserts and reference copies, each of the reference copies having edge portions, each of the cover board having edges, the device being supported on a substantially horizontal surface and comprising:

a board magazine adapted for storing cover boards;

a board feeding-in system adapted for feeding in cover boards from the board magazine and the back insert;

a copy magazine adapted for storing reference copies;

a copy feeding-in system adapted for feeding in reference copies from the copy magazine;

a glue-applying roll;

a copy cylinder adapted for gripping the reference copies fed in by the copy feeding-in system, guiding the reference copies past the glue-applying roll, and joining the reference copies to the cover boards and back insert to form a book cover;

a tucking-in and pressing-on device adapted for receiving the book cover, folding edge portions of the reference copies protruding beyond the edges of the cover boards around the edges of the cover board, and pressing the book cover; and a feeding-out device adapted for delivering the book covers in stacks;

wherein the feeding-in of cover boards, back inserts and reference copies and delivery of book covers defines a direction of material flow through the apparatus, the direction of material flow ascending, relative to the horizontal surface, as far as the feeding-out device.

2. Apparatus according to claim 1 wherein the direction of material flow occurs in a common plane as far as the feeding-out device.

3. Apparatus according to claim 1 wherein the direction of material flow occurs in a first ascending plane as far as the tucking-in and pressing-on device, the book cover being directed downwardly onto a second ascending plane as the edge portions of the reference copies are folded in the tucking-in and pressing-on device, the book cover being conveyed in the second ascending plane into the feeding-out device.

4. Apparatus according to claim 3, wherein the first and second ascending planes form an angle with the horizontal surface in the range from 3° to 25°.

5. Apparatus according to claim 4 wherein the angle is substantially equal to 8°.

6. Apparatus according to claim 1 further comprising a prestacking band adapted for transferring cover boards to the board magazine, the prestacking band extending substantially parallel to the horizontal surface.

7. Apparatus according to claim 1 wherein the feeding-out device extends substantially parallel to the horizontal surface.

8. Apparatus according to claim 7 wherein the feeding-out device feeds the stacked book covers in a direction which is transverse to the direction of material flow.

9. Apparatus according to claim 8 wherein the feeding-out device selectively feeds the stacked book covers in a first direction which is transverse to the direction of material flow or feeds individual book covers in a second direction which is opposite to the first direction.

10. Apparatus according to claim 1 wherein the copy-feeding-in system is disposed below the tucking-in and pressing-on device.

11. Apparatus according to claim 10 wherein the copy magazine is disposed upstream of the feeding-out device, viewed in the direction of material flow.

12. Apparatus for manufacturing book-binding covers from cover boards, back inserts and reference copies, each of the reference copies having edge portions, each of the cover board having edges, the device being supported on a substantially horizontal surface and comprising:

a board magazine adapted for storing cover boards;

a board feeding-in system adapted for feeding in cover boards from the board magazine and the back insert;

a copy magazine adapted for storing reference copies;

a copy feeding-in system adapted for feeding in reference copies from the copy magazine;

a glue-applying roll;

a copy cylinder adapted for gripping the reference copies fed in by the copy feeding-in system, guiding the reference copies past the glue-applying roll, and joining the reference copies to the cover boards and back insert to form a book cover;

a tucking-in and pressing-on device adapted for receiving the book cover, folding edge portions of the reference copies protruding beyond the edges of the cover boards around the edges of the cover board, and pressing the book cover; and a feeding-out device adapted for delivering the book covers in stacks;

wherein the feeding-in of cover boards, back inserts and reference copies and delivery of book covers defines a direction of material flow through the apparatus, the direction of material flow occurring in a first ascending plane, relative to the horizontal surface, as far as the tucking-in and pressing-on device, the book cover being directed downwardly onto a second ascending plane as the edge portions of the reference copies are folded in the tucking-in and pressing-on device, the book cover being conveyed in the second ascending plane into the feeding-out device.

13. Apparatus for manufacturing book-binding covers from cover boards, back inserts and reference copies, each of the reference copies having edge portions, each of the cover board having edges, the device being supported on a substantially horizontal surface and comprising:

a board magazine adapted for storing cover boards;

a board feeding-in system adapted for feeding in cover boards from the board magazine and the back insert;

a copy magazine adapted for storing reference copies;

a copy feeding-in system adapted for feeding in reference copies from the copy magazine;

a glue-applying roll;

a copy cylinder adapted for gripping the reference copies fed in by the copy feeding-in system, guiding the reference copies past the glue-applying roll, and joining the reference copies to the cover boards and back insert to form a book cover;

a tucking-in and pressing-on device adapted for receiving the book cover, folding edge portions of the reference copies protruding beyond the edges of the cover boards around the edges of the cover board, and pressing the book cover; and a feeding-out device adapted for delivering the book covers in stacks;

wherein the feeding-in of cover boards, back inserts and reference copies and delivery of book covers defines a direction of material flow through the apparatus, the feeding-out device selectively feeding the stacked book covers in a first direction which is transverse to the direction of material flow or feeding individual book covers in a second direction which is opposite to the first direction.

14. Apparatus for manufacturing book-binding covers from cover boards, back inserts and reference copies, each of the reference copies having edge portions, each of the cover board having edges, the device being supported on a substantially horizontal surface and comprising:

a board magazine adapted for storing cover boards;

a board feeding-in system adapted for feeding in cover boards from the board magazine and the back insert;

a copy magazine adapted for storing reference copies;

a copy feeding-in system adapted for feeding in reference copies from the copy magazine;

a glue-applying roll;

a copy cylinder adapted for gripping the reference copies fed in by the copy feeding-in system, guiding the reference copies past the glue-applying roll, and joining the reference copies to the cover boards and back insert to form a book cover;

a tucking-in and pressing-on device adapted for receiving the book cover, folding edge portions of the reference copies protruding beyond the edges of the cover boards around the edges of the cover board, and pressing the book cover; and a feeding-out device adapted for delivering the book covers in stacks;

wherein the copy-feeding-in system is disposed below the tucking-in and pressing-on device.

* * * * *